US006122929A

United States Patent [19]

Yamazaki

[11] Patent Number: 6,122,929

[45] **Date of Patent: *Sep. 26, 2000**

[54] ACCUMULATOR

[75] Inventor: Keiji Yamazaki, Minamikawachimachi, Japan

[73] Assignee: Showa Aluminum Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/991,417

[22] Filed: Dec. 16, 1997

[30] Foreign Application Priority Data

Dec. 18, 1996 [JP] Japan ..... 8-338336

[51] Int. Cl.[7] ..... F25B 43/00

[52] U.S. Cl. ..... 62/474

[58] Field of Search ..... 62/474, 85, 195

[56] References Cited

U.S. PATENT DOCUMENTS

| | | | |
|---|---|---|---|
| 2,325,657 | 8/1943 | Burkness | 62/474 |
| 3,545,227 | 12/1970 | Grahl | 62/474 |
| 3,785,164 | 1/1974 | Wrenn, Jr. | 62/474 |
| 4,270,934 | 6/1981 | Widdowson et al. | 55/316 |
| 4,331,001 | 5/1982 | Jones | 62/503 |
| 4,354,362 | 10/1982 | Shumacher et al. | 62/474 |
| 4,436,623 | 3/1984 | Cullen et al. | 210/282 |
| 4,509,340 | 4/1985 | Mullally et al. | 62/503 |
| 4,707,999 | 11/1987 | Ohta et al. | 62/474 |
| 4,800,737 | 1/1989 | Smith et al. | 62/503 |
| 5,038,582 | 8/1991 | Takamatsu | 62/474 |
| 5,282,370 | 2/1994 | Kiblawi et al. | 62/503 |
| 5,398,523 | 3/1995 | Yoshii et al. | 62/474 |
| 5,515,696 | 5/1996 | Hutchison | 62/474 |
| 5,580,451 | 12/1996 | Tack | 210/266 |
| 5,635,525 | 6/1997 | Riemenschneider | 62/474 |

FOREIGN PATENT DOCUMENTS

| | | |
|---|---|---|
| 0 849 549 | 12/1997 | European Pat. Off. . |
| 2 396 902 | 7/1977 | France . |
| 26 02 582 | 1/1996 | Germany . |
| 296 13 052 | 7/1996 | Germany . |

*Primary Examiner*—William E. Tapoical

[57] ABSTRACT

A tank of an accumulator is divided into an upper room and lower room by a dryer unit. The upper room is divided into a right upper divided room located at a refrigerant inlet side and a left upper divided room located at a refrigerant outlet side by a separating wall formed with the dryer unit. The right and left upper divided rooms communicate with each other through a plurality of apertures that are provided in the separating wall. Further, an oil returning tube is integrally formed with the dryer unit, and a filter is provided in the dryer unit.

16 Claims, 6 Drawing Sheets

ACCUMULATOR

BACKGROUND OF THE INVENTION

1. Field of the Invention

The present invention relates to an accumulator used in a refrigerant cycle for an automobile air conditioner or the like.

2. Related Art

A conventional accumulator includes, as shown in FIG. 6, for example, a U-shaped suction pipe 52 in a tank 51 to separate gaseous refrigerant and liquid refrigerant that are evaporated in an evaporator (not shown). Further, for an effective separation of gaseous refrigerant and liquid refrigerant under the circumstances in which the accumulator suffers from vibration or swing, a defroster 53 in the shape of an umbrella or reversed-cup is provided in the conventional accumulator. Furthermore, to remove water, a dryer unit 54 is provided in the tank 51. Such a dryer unit 54 has a complicated structure because of a space for the suction pipe 52. Besides, to return oil to a compressor, a filter 55 with a peculiar structure is mounted at a bottom end of the suction pipe 52.

Various structures for an accumulator have been proposed, for example, as shown in Japanese patent unexamined publication No. 51-42157 and Japanese utility model unexamined publication No. 55-26329.

However, such a conventional accumulator is composed of many parts, such as a suction pipe 52, a defroster 53, a dryer unit 54, a filter 55, etc. Further, each of such parts has a complicated and peculiar shape and/or structure, resulting in high production cost.

There is another problem in that a pressure loss of refrigerant passing through the accumulator is relatively large since refrigerant is sucked through the suction pipe 52 provided in the tank 51 and a defroster 53 is provided in the tank. The filter 55 mounted in the manner described above also causes an increase in the refrigerant pressure loss.

SUMMARY OF THE INVENTION

The present invention has been made to overcome the disadvantages in the conventional accumulator as described above.

An object of the present invention is to provide an accumulator having a reduced number of parts and a simplified inner structure, which is low in production cost.

Another object of the present invention is to provide an accumulator having a structure which can decrease a refrigerant pressure loss and improve a system efficiency.

The above-referenced object is achieved by an accumulator comprising:

a tank;

a dryer unit disposed at an intermediate portion in the direction of a height of the tank to divide an inside of the tank into an upper room and a lower room; and a separating wall dividing the upper room into right and left upper divided rooms, one being located at a refrigerant inlet side and the other being located at a refrigerant outlet side, wherein the upper and lower rooms are communicated with each other through the dryer unit, and wherein the upper divided rooms are communicated with each other through a plurality of apertures provided in the separating wall.

As mentioned above, the upper room located above the dryer unit is divided into right and left upper divided rooms, one being located at the refrigerant inlet side and the other being located at the refrigerant outlet side, and the upper divided rooms communicate with each other through a plurality of apertures provided in the separating wall. Accordingly, when a mixture of liquid refrigerant and gaseous refrigerant is introduced into an upper divided room located at the refrigerant inlet side, the liquid refrigerant is intercepted by the separating wall to follow a path therethrough and thus goes downward, while the gaseous refrigerant is sucked into the adjacent upper divided room located at the refrigerant outlet side through the apertures of the separating wall. Thus, the gaseous refrigerant is separated from the liquid refrigerant and only the gaseous refrigerant is sucked into a compressor from the upper divided room located at the refrigerant outlet side.

Because the gaseous refrigerant flows within the large right and left upper divided rooms and travels from one of the rooms to the other through a plurality of apertures provided in the separating wall, the refrigerant pressure loss is decreased. The liquid refrigerant goes downward as described above and the water contained therein is removed by the dryer unit. The gaseous phase of the refrigerant in the lower room is sucked up into an upper divided room located at the refrigerant outlet side through the dryer unit and is then sucked into a compressor.

To separate the gaseous refrigerant from the liquid refrigerant, only the separating wall having a plurality of apertures provided therein is provided. Besides, the separating wall is preferably integrally formed with the dryer unit. Thus, the number of parts is reduced.

Further, the separation of the gaseous refrigerant and the liquid refrigerant and the removal of water, etc., are conducted by means of the structure that the dryer unit dividing the inside of the tank into the upper and lower rooms is provided in the tank and the separating wall located in the upper room above the dryer unit to divide it into the right and left upper divided rooms is provided. Therefore, a suction pipe of a complicated shape can be excluded, and the structure of the dryer unit is simplified. Thus, a simple inner structure of the tank is accomplished.

In the accumulator, it is preferable that an oil returning tube extending from a bottom of the lower room to an upper portion of the upper divided room located at the refrigerant outlet side is provided and the upper and lower rooms communicate with each other through a filter provided in the dryer unit for the removal of impurities. More preferably, the oil returning tube is integrally formed with the dryer unit to reduce the number of parts for returning oil. Furthermore, because the upper and lower rooms of the tank communicate with each other through the filter for the removal of impurities, which is provided in the dryer unit, the impurities are removed by the filter, and it is no longer necessary to provide a filter having a peculiar structure at the end portion of the oil returning tube. Thus, the inner structure of the tank for oil returning can be simplified and the pressure loss can also be reduced.

Other objects, features and advantages of the present invention will now be clarified by the following explanation of the preferred embodiments.

DETAILED DESCRIPTION OF THE PREFERRED EMBODIMENTS

A preferred embodiment of the present invention will now be described with reference to the accompanying drawings.

Figure 1B:
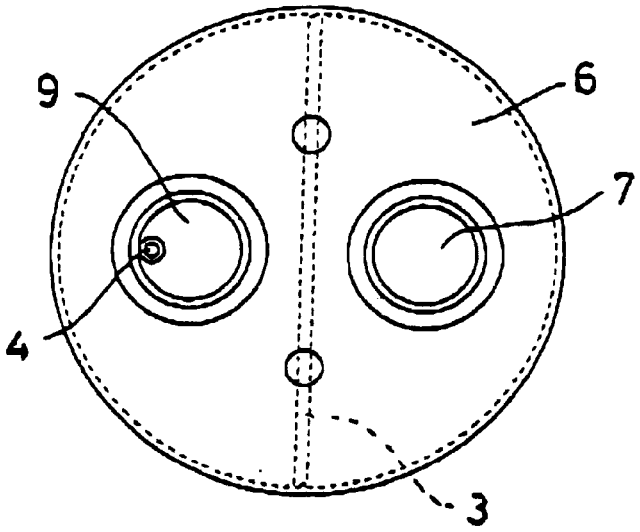
FIG. 1B is a top plan view thereof.
Figure 1A:
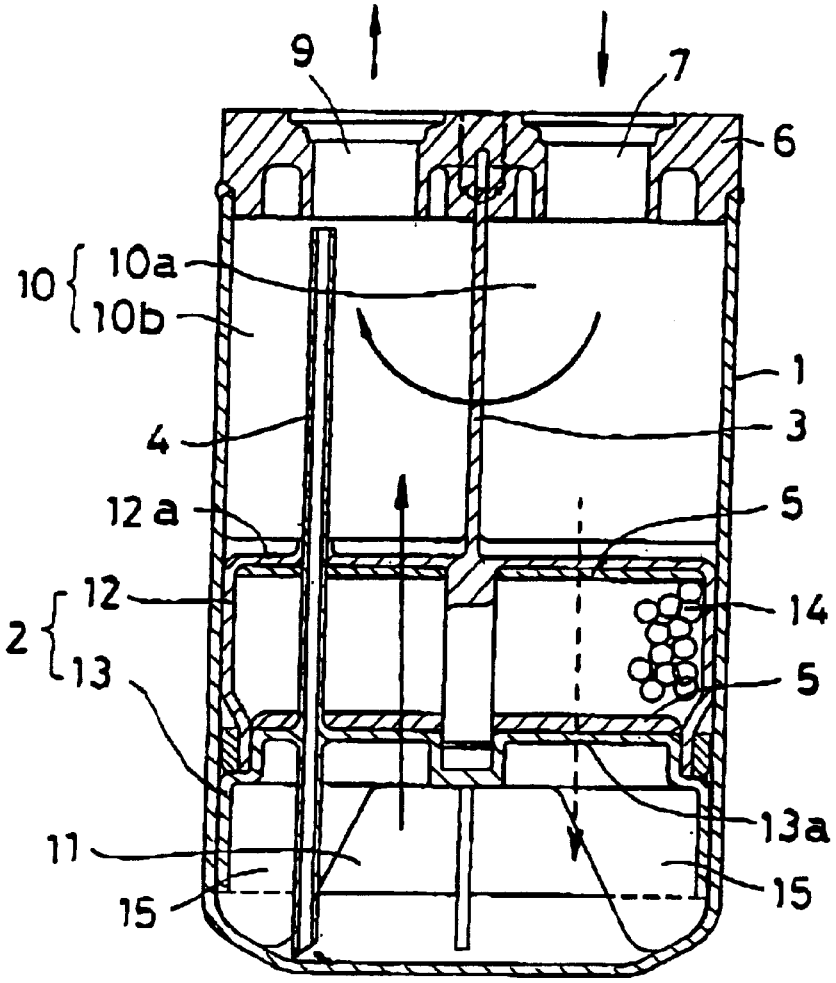
FIG. 1A is a front cross-sectional view of the accumulator of an embodiment according to the present invention.
Figure 2:
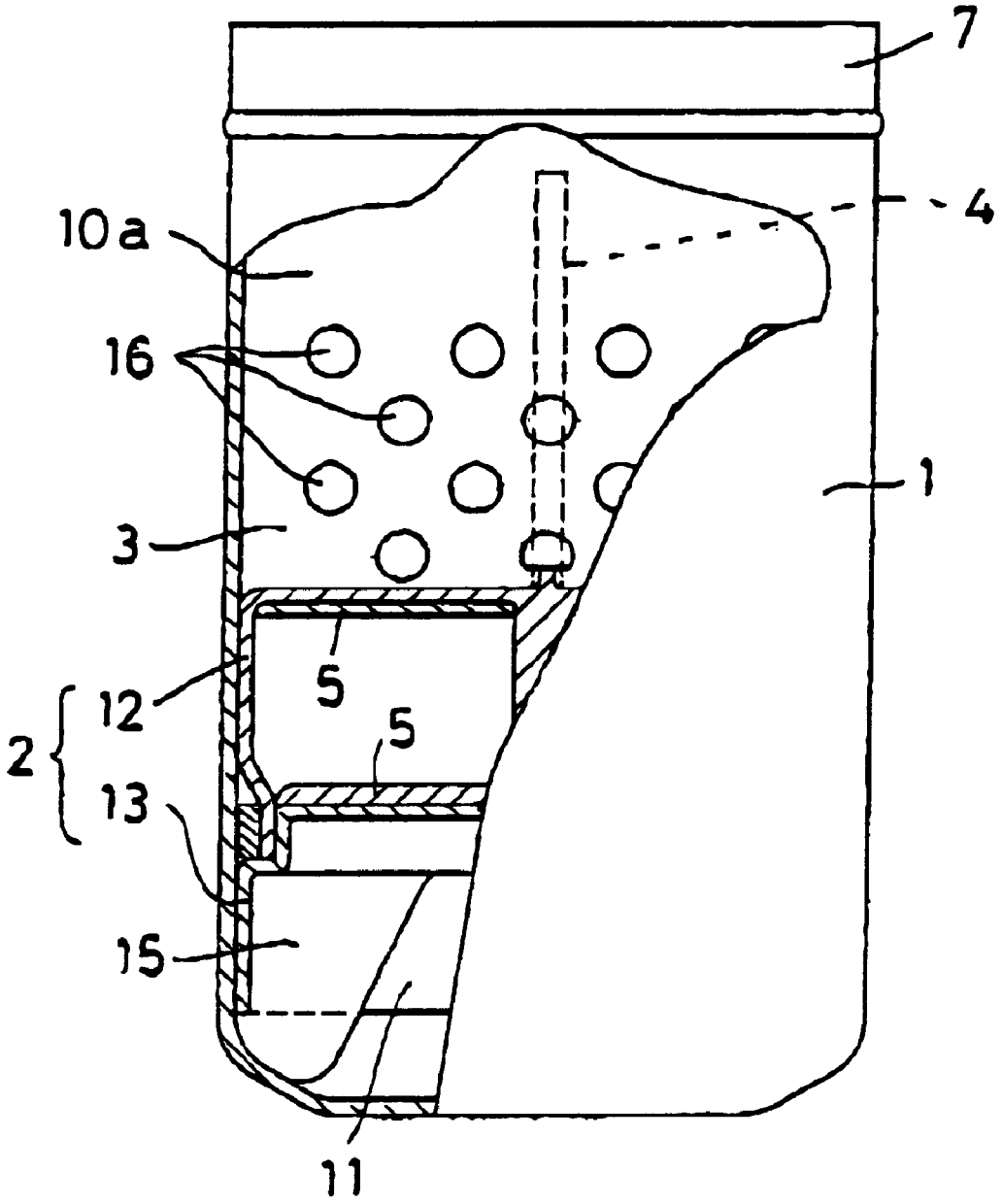
FIG. 2 is a partially broken side cross-sectional view of the accumulator.

In the accumulator illustrated in FIGS. 1A, 1B and 2, the numerals 1 to 5 denote a tank, a dryer unit, a separating wall, a tube for returning oil and a filter, respectively.

The tank 1 is in the shape of a cylinder having a bottom with a predetermined height. An upper opening of the tank 1 is closed by a header 6. The header 6 has a refrigerant inlet port 7 and a refrigerant outlet port 9. The dryer unit 2 is fitted in the tank 1 at an intermediate portion thereof in a direction of the height. The inside of the tank 1 is divided into an upper room 10 and a lower room 11 by the dryer unit 2. The upper and lower rooms 10, 11 communicate with each other through the dryer unit 2.

Figure 3C:
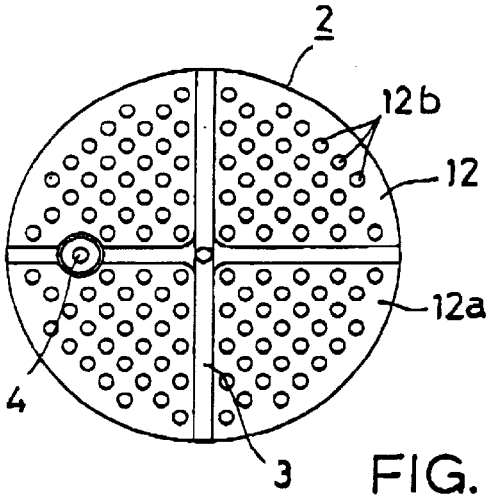
FIG. 3C is a top plan view thereof.
Figure 3A:
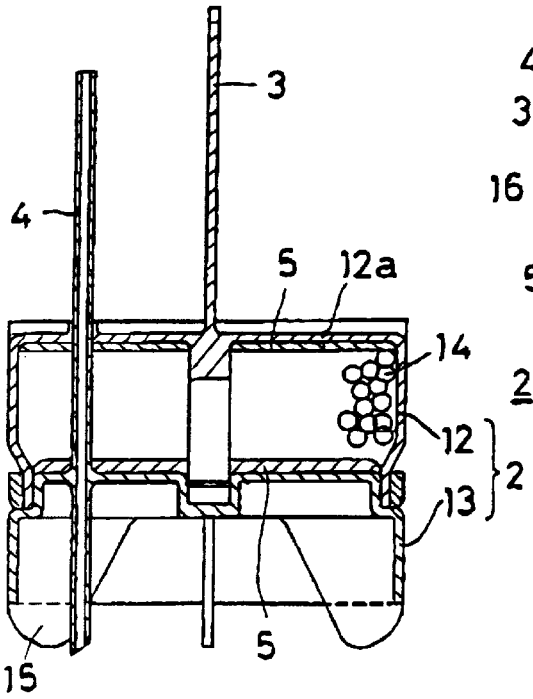
FIG. 3A is a front cross-sectional view of a dryer unit.
Figure 3B:
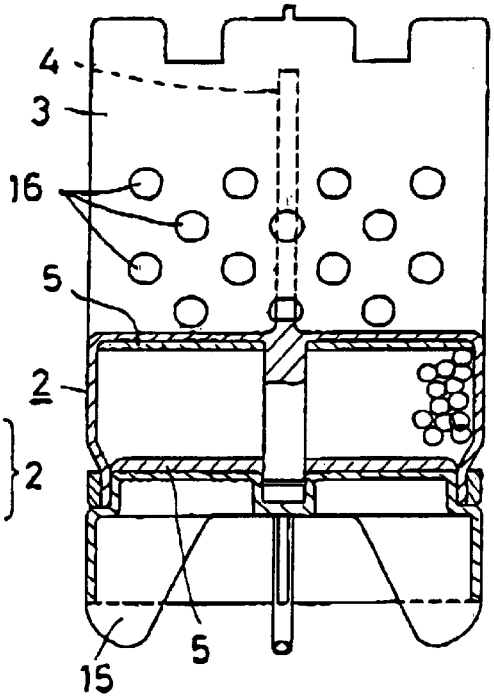
FIG. 3B is a side cross-sectional view thereof.
Figure 4C:
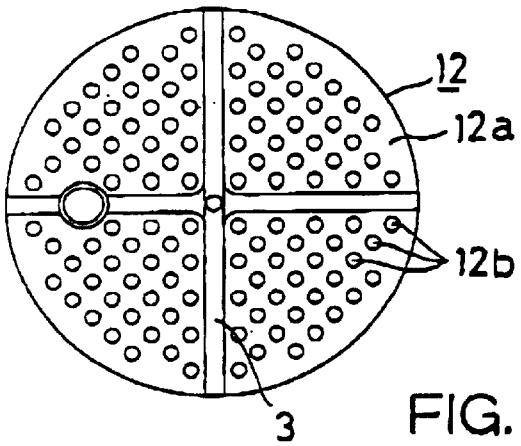
FIG. 4C is a top plan view thereof.
Figure 4A:
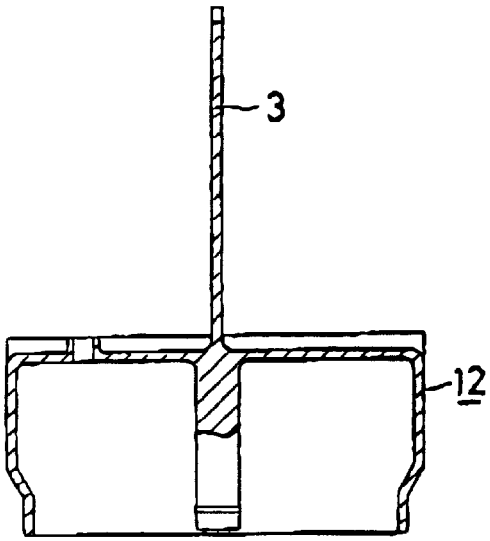
FIG. 4A is a front cross-sectional view of a reversed-cup like cover.
Figure 4B:
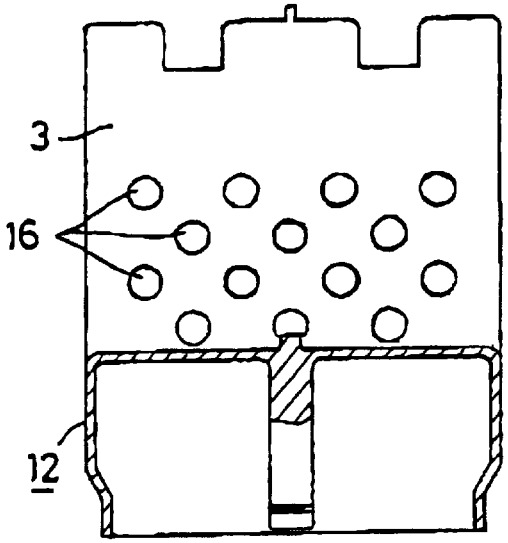
FIG. 4B is a side cross-sectional view thereof.
Figure 5C:
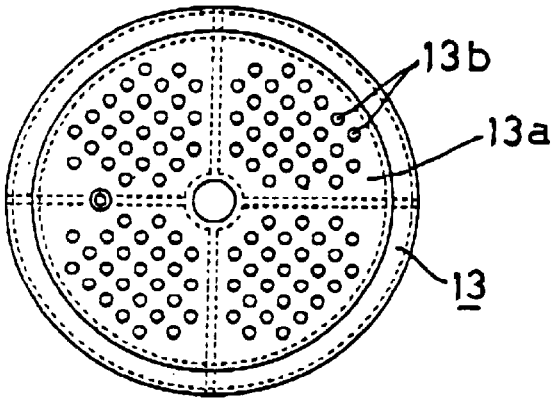
FIG. 5C is a top plane view thereof.

As shown in FIGS. 3 to 5, the dryer unit 2 includes a reversed cup-like cover 12 and a cap-like cover 13. A lower opening of the reversed cup-like cover 12 is closed by the cap-like cover 13, and dryer agents 14 are confined therebetween. The diameter of the outer periphery of the dryer unit 2 is generally the same as the diameter of the inner periphery of the tank 1, As shown in FIG. 4C, a multitude of small apertures 12*b* are provided in approximately the whole area of an upper wall 12*a* of the reversed cup-like cover 12. On the other hand, as shown in FIG. 5C, a multitude of small apertures 13*b* are provided in approximately the whole area of a covering portion 13*a* of the cap-like cover 13. The cap-like cover 13 has a plurality of downwardly protruded legs 15 integrally formed with the cap-like cover 13. With the dryer unit 2 supported by the legs 15 at a bottom of the tank 1, the inside of the tank 1 is divided by the dryer unit 2 into the upper room 10 and the lower room 11. The upper and lower rooms 10, 11 communicate with each other through the small apertures 12*b* formed in the upper wall 12*a* of the reversed cup-like cover 12 and the small apertures 13*b* formed in the covering portion of 13*a* of the cap-like cover 13.

The positions of the reversed cup-like cover 12 and cap-like cover 13 may be arranged such that an upper opening of the cup-like cover 12 is closed by the cap-like cover 13.

The separating wall 3 is a flat wall and placed in the upper room 10 of the tank 1 to divide the upper room 10 into a right upper divided room 10*a* and a left upper divided room 10*b* as shown in FIGS. 1A and 2. In FIG. 1A, the right upper divided room 10*a* communicates the refrigerant inlet port 7 of the header 6 to form a refrigerant inlet side room on the other hand, the left upper divided room 10*b* communicates with the refrigerant outlet port 9 of the header 6 to form a refrigerant outlet side room. As shown in FIGS. 4A–4C, the separating wall 3 is integrally formed with the reversed cup-like cover 12 such that the separating wall 3 protrudes upward from a top surface of the upper wall 12*a* of the reversed cup-like cover 12 of the dryer unit 2. As shown in FIG. 4B, a plurality of apertures 16 are provided in the separating wall 3 in a scattered state so that the right and left upper divided rooms 10*a*, 10*b* communicate with each other through the apertures 16. The separating wall 3 may also be made so as not to be integrally formed with the reversed cup-like cover 12.

Figure 5A:
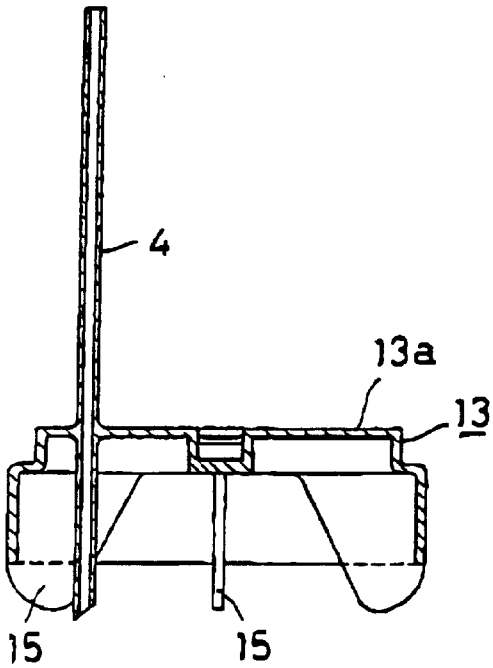
FIG. 5A is a front cross-sectional view of a cap-like cover.
Figure 5B:
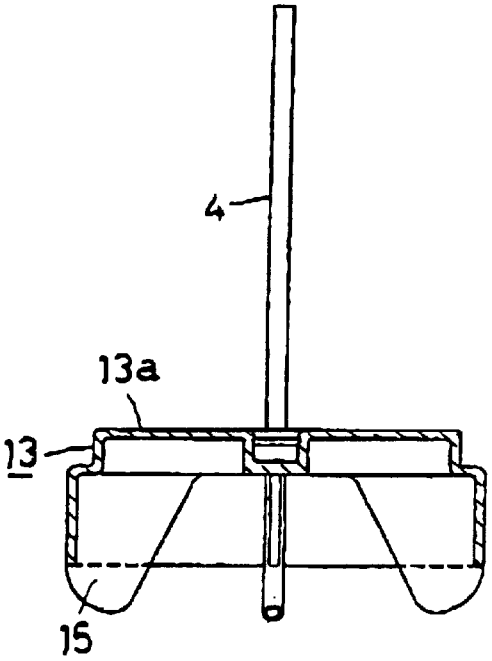
FIG. 5B is a side cross-sectional view thereof.
Figure 6:
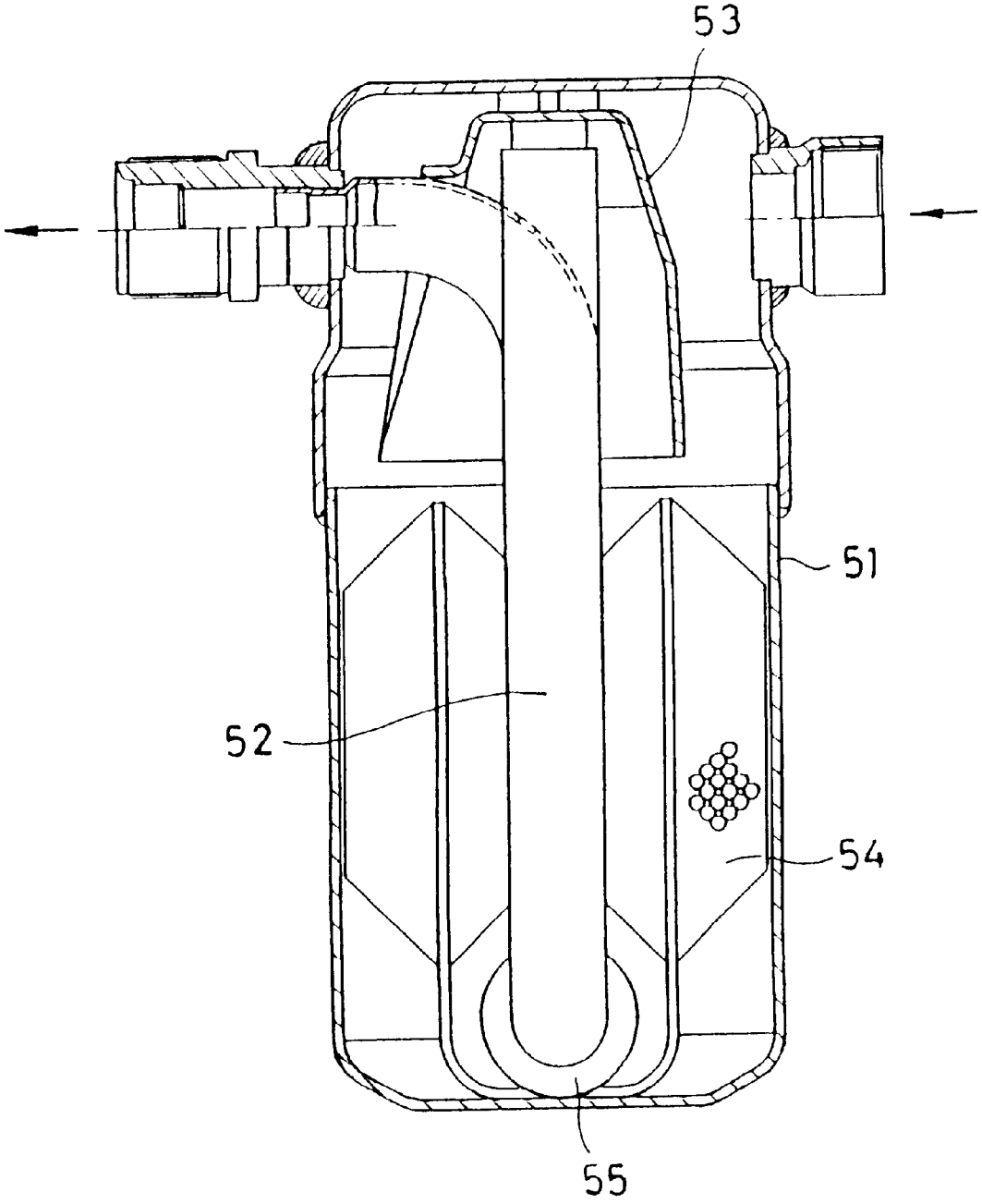
FIG. 6 PRIOR ART
FIG. 6 is a front cross-sectional view of a conventional accumulator.

The oil returning tube 4 extends in a direction of up and down as shown in FIG. 1A. A lower end of the tube 4 is located at a bottom portion of the lower room 11 of the tank 1. An upper end of the tube 4 extends through the upper wall 12*a* of the reversed cup-like cover 12 of the dryer unit 2 and is located at an upper portion of the refrigerant outlet side upper divided room 10*b* of the upper room 10 to correspond to the refrigerant outlet port 9. As shown in FIGS. 5A–5C, the tube 4 is integrally formed with the cap-like cover 13 of the dryer unit 2 and extends in an up and down direction from the covering portion 13*a* of the cap-like cover 13. The oil returning tube 4 may also be made so as not to be integrally formed with the cap-like cover 13.

As shown in FIGS. 1A and 3, a filter 5 is disposed along the whole area of a lower surface of the upper wall 12*a* of the reversed cup-like cover 12, and another filter 5 is disposed along the whole area of an upper surface of the covering portion 13*a* of the cap-like cover 13.

In assembling the accumulator, the reversed cup-like cover 12 and the cap-like cover 13 are combined to form the dryer unit 2 such that the dryer agent 14 and the filters 5, 5 are contained within the dryer unit 2. Then, the dryer unit 2 is inserted into the tank 1, and thereafter the tank 1 is closed by the header 6. Thus, assembly of the accumulator can be performed extremely easily.

The tank 1, the header 6, the reversed cup-like cover 12, the cap-like cover 13, and the like, may be made of materials having a good formability such as an aluminum, an aluminum alloy, a resin, or the like.

In the above-described accumulator, the mixture of liquid refrigerant and gaseous refrigerant, which has been evaporated in an evaporator (not shown), is introduced into the refrigerant inlet side upper divided room 10*a* through the inlet port 7 of the header 6 as shown in FIG. 1A. However, the liquid refrigerant is intercepted by the separating wall 3 to follow a path through to the refrigerant outlet side upper divided room 10*b*. The liquid refrigerant, thus, goes downward as indicated by the dotted arrow as illustrated in FIG. 1A. While, the gaseous refrigerant is sucked into the refrigerant outlet side upper divided room 10*b* through the apertures 16 of the separating wall 3. Thus, the gaseous refrigerant is separated from the liquid refrigerant and only the gaseous refrigerant is sucked from the refrigerant outlet side upper divided room 10*b* into a compressor (not shown) through the outlet port 9.

The refrigerant can pass through the accumulator with a small pressure loss because the gaseous refrigerant flows through the large rooms 10*a* and 10*b* divided by the separating wall 3 and the gaseous refrigerant travels from the refrigerant inlet side upper divided room 10*a* to the refrigerant outlet side upper divided room 10*b* through a plurality of apertures 16 provided in the separating wall 3 in a scattered state.

The liquid refrigerant goes downward as described above and is accumulated in the lower room 11 after contained water is removed by the dryer unit 2. The gaseous phase of the refrigerant accumulated in the lower room 11 is sucked up into the refrigerant outlet side upper divided room 10*b* through the dryer unit 2 as shown by the solid arrow illustrated in FIG. 1A, and is then sucked into a compressor (not shown).

Lubricant oils for the compressor contained in the refrigerant go downward together with the liquid refrigerant and pass through the dryer unit 2. Impurities included in the lubricant oil are removed by the filters 5, 5 provided in the dryer unit 2. After that, the oil is collected in the lower room 11 and then sucked up through the oil returning tube 4 into a compressor (not shown) together with the gaseous refrigerant.

To separate the gaseous refrigerant from the liquid refrigerant, only the separating wall 3 having a plurality of apertures 16 provided therein in a scattered state is provided. resides, the separating wall 3 is integrally formed with the dryer unit 2. Thus the number of parts is reduced.

Further, the separation of the gaseous refrigerant and the liquid refrigerant and the removal of water, etc., are conducted by means of the structure that the dryer unit 2 dividing the inside of the tank 1 into the upper and lower rooms 10, 11 is provided in the tank 1 and the separating wall 3 located in the upper room 10 above the dryer unit 2 to divide it into the right and left upper divided rooms 10*a*, 10*b* is provided. Therefore, a suction pipe of a complicated shape can be excluded, and the structure of the dryer unit 2 can be simplified. And thus, a simple inner structure of the tank can be accomplished.

Further, because the oil returning tube 4 is integrally formed with the dryer unit 2, the number of parts for returning oil is reduced. Furthermore, because the upper room 10 and lower room 11 of tank 1 communicate through the filters 5 for removal of impurities, which are provided in the dryer unit 2, impurities are removed by the filters 5. Accordingly, it is no longer necessary to provide a filter having a peculiar structure at the end portion of the oil returning tube 4. Thus, the inner structure of the tank 1 for the oil returning is simplified and the pressure loss is also diminished.

As described above, in the accumulator of the present invention, the upper room located above the dryer unit is divided into right and left upper divided rooms, one being located at the refrigerant inlet side and the other being located at the refrigerant outlet side, and the upper divided rooms communicate with each other through a plurality of apertures provided in the separating wall. Accordingly, when a mixture of liquid refrigerant and gaseous refrigerant is introduced into an upper divided room located at the refrigerant inlet side, the liquid refrigerant is intercepted by the separating wall to follow a path therethrough and thus goes downward, while the gaseous refrigerant is sucked into the adjacent upper divided room located at the refrigerant outlet side through the apertures in the separating wall. Thus, the gaseous refrigerant is separated from the liquid refrigerant and only the gaseous refrigerant is sucked into the compressor from the upper divided room located at the refrigerant outlet side.

Because the gaseous refrigerant flows within the large right and left upper divided rooms and travels from one of the rooms to the other through a plurality of apertures provided in the separating wall, the refrigerant pressure loss is decreased. The liquid refrigerant goes downward as described above, and water contained therein is removed by the dryer unit. The gaseous phase of the refrigerant in the lower room is sucked up into an upper divided room located at the refrigerant outlet side through the dryer unit and is then sucked into a compressor.

To separate the gaseous refrigerant and the liquid refrigerant, only the separating wall having a plurality of apertures provided therein is provided. Besides, the separating wall is preferably formed integrally with the dryer unit. Thus, the number of parts is reduced.

Further, the separation of the gaseous refrigerant and liquid refrigerant and the removal of water, etc., are conducted by means of the structure that the dryer unit dividing the inside of the tank into the upper and lower rooms is provided in the tank and the separating wall located in the upper room above the dryer unit to divide it into the right and left upper divided rooms is provided. Therefore, a suction pipe of a complicated shape can be excluded, and the structure of the dryer unit is simplified. Thus, a simple inner structure of the tank is accomplished to save the production cost.

In the accumulator, it is preferable that the oil returning tube extending from a bottom of the lower room to an upper portion of the upper divided room located at the refrigerant outlet side is provided and the upper room and the lower room communicate with each other through a filter provided in the dryer unit for removal of impurities. More preferably, the oil returning tube is formed integrally with the dryer unit to reduce the number of parts for returning oil. Furthermore, because the upper room and the lower room of the tank communicate with each other through the filter for the removal of impurities, which is provided in the dryer unit, the impurities are removed by the filter and it is no longer necessary to provide a filter having a peculiar structure at the end portion of the oil returning tube. Thus, the inner structure of the tank for oil returning can be simplified and the pressure loss can also be reduced.

Although the invention has been described in connection with specific embodiments, the invention is not limited to such embodiments, and as would be apparent to those skilled in the art, various substitutions and modifications within the scope and spirit of the invention are contemplated.

What is claimed is:

1. An accumulator comprising:

a tank;

a dryer unit disposed at an intermediate portion in a direction of height of said tank to divide an inside of said tank into an upper room and a lower room; and a separating wall dividing said upper room into right and left upper divided rooms, one being located at a refrigerant inlet side and the other being located at a refrigerant outlet side, wherein said upper and lower rooms are communicated with each other through said dryer unit, and wherein said upper divided rooms are communicated with each other through a plurality of apertures provided in said separating wall.

2. An accumulator as recited in claim 1, wherein said separating wall is integrally formed with said dryer unit.

3. An accumulator as recited in claim 1, further comprising an oil returning tube extending upward from a bottom portion of said lower room of said tank to an upper portion of said upper divided room located at a refrigerant outlet side of the upper room, and wherein said upper and lower rooms of said tank are communicated with each other through a filter for removal of impurities provided in said dryer unit.

4. An accumulator as recited in claim 2, further comprising an oil returning tube extending upward from a bottom portion of said lower room of said tank to an upper portion of said upper divided room located at refrigerant outlet side of the upper room, and wherein said upper and lower rooms of said tank are communicated with each other through a filter for removal of impurities provided in said dryer unit.

5. An accumulator as recited in claim 3, wherein said oil returning tube is integrally formed with said dryer unit.

6. An accumulator as recited in claim 4, wherein said oil returning tube is integrally formed with said dryer unit.

7. An accumulator as recited in claim 1, wherein said dryer unit comprises a cup-like cover and a cap-like cover, and an opening of said cup-like cover is closed by said cap-like cover to contain a dryer agent therein.

8. An accumulator as recited in claim 7, wherein a plurality of legs extending downward are provided on one of said cup-like cover or said cap-like cover which is located lower than the other, and said dryer unit is disposed in said tank with the legs supported at a bottom portion of said tank.

9. An accumulator as recited in claim 1, wherein said dryer unit comprises a revered cup-like cover and a cap-like cover, wherein a lower opening of the reversed cup-like cover is closed by said cap-like cover to contain a dryer agent therein, and wherein the separating wall comprises a flat wall that is provided so as to extend upwards from a top surface of an upper wall of said cup-like cover.

10. An accumulator as recited in claim 2, wherein said dryer unit comprises a revered cup-like cover and a cap-like cover, wherein a lower opening of the reversed cup-like cover is closed by said cap-like cover to contain a dryer agent therein, and wherein the separating wall comprises a flat wall that is provided so as to extend upwards from a top surface of an upper wall of said cup-like cover.

11. An accumulator as recited in claim 3, wherein said dryer unit comprises a reversed cup-like cover and a cap-like cover, and a lower opening of said reversed cup-like cover is closed by said cap-like cover so as to contain a dryer agent therein, and wherein said oil returning tube is provided on said cap-like cover and extends upward through an upper wall of said cup-like cover.

12. An accumulator as recited in claim 4, wherein said dryer unit comprises a reversed cup-like cover and a cap-like cover, and a lower opening of said reversed cup-like cover is closed by said cap-like cover so as to contain a dryer agent therein, and wherein said oil returning tube is provided on said cap-like cover and extends upward through an upper wall of said cup-like cover.

13. An accumulator as recited in claim 7, wherein a plurality of apertures are provided in a scattered state over substantially all of a bottom portion of said cup-like cover and a covering portion of said cap-like cover, and further comprising filters disposed on an inner surface of said bottom portion of said cup-like cover and on an inner surface of said covering portion of said cap-like cover.

14. An accumulator as recited in claim 1, wherein said tank is of a cylindrical shape with a predetermined height and has a bottom and an opening end, wherein said opening end is closed by a header, and said header is provided with a refrigerant inlet port and a refrigerant outlet port.

15. An accumulator as recited in claim 14, wherein said tank and header are made of a material selected from the group consisting of an aluminum, an aluminum alloy and a resin.

16. The accumulator as recited in claim 7, wherein the cup-like cover and the cap-like cover are made of a material selected from the group consisting of an aluminum, an aluminum alloy and a resin.

* * * * *